United States Patent [19]

Clark et al.

[11] Patent Number: 5,063,632

[45] Date of Patent: Nov. 12, 1991

[54] SOOTBLOWER WITH CONDENSATE SEPARATOR

[75] Inventors: John E. Clark, North Olmsted, Ohio; Jack D. Shenker, Kinnleon, N.J.

[73] Assignee: The Babcock & Wilcox Company, New Orleans, La.

[21] Appl. No.: 624,722

[22] Filed: Dec. 4, 1990

[51] Int. Cl.[5] ..... F23J 3/00

[52] U.S. Cl. ..... 15/316.1; 15/317; 122/390; 165/95

[58] Field of Search ..... 15/316.1, 317; 165/95; 122/390

[56] References Cited

U.S. PATENT DOCUMENTS

| | | | |
|---|---|---|---|
| 1,809,221 | 6/1931 | Snow et al. . | |
| 2,904,260 | 9/1959 | Schueler et al. | 239/132 |
| 3,436,786 | 4/1969 | Rickard et al. | 15/317 |
| 3,593,691 | 7/1971 | Wirths et al. | 122/390 |
| 4,209,028 | 6/1980 | Shenker | 134/86 R |
| 4,351,277 | 9/1982 | Ryan et al. | 122/390 |
| 4,380,843 | 4/1983 | Sullivan et al. | 15/316.1 |

*Primary Examiner*—Chris K. Moore

*Attorney, Agent, or Firm*—Harness, Dickey & Pierce

[57] ABSTRACT

A sootblower for the cleaning of internal surfaces of large scale boilers which are subject to the accumulation of soot or slag encrustations. In instances where a sootblower is used to project the jet of steam of steam or a steam/air mixture, between actuation cycles, condensate can form in the sootblower or the associated piping. At the beginning of an actuation cycle the condensate is ejected from the sootblower. If the condensate impinges against the heat transfer surfaces inside the boiler it can cause damage to these surfaces through excessive thermal and mechanical shock. In accordance with this invention the sootblower is provided with a nozzle block assembly incorporating a condensate separator which causes condensate to be ejected by the lance tube away from impact with the heat transfer surfaces where it can be safely dissipated from the boiler without causing damage to the heat transfer surfaces which are cleaned using a substantially fully vaporous pure spray of sootblowing medium.

15 Claims, 2 Drawing Sheets

SOOTBLOWER WITH CONDENSATE SEPARATOR

BACKGROUND AND SUMMARY OF THE INVENTION

This invention is related to a cleaning device for heat exchanger cleaning and particularly to one for large scale heat exchangers for the reduction of soot and/or slag encrustations forming on heat surfaces within the heat exchanger.

During the combustion process of fossil fuels, the internal heat exchange surfaces of boilers become encrusted with slag and soot. In order to enhance the thermal and combustion efficiency of such boilers, it is periodically necessary to reduce the amount of encrustations on the heat exchanger surfaces. Numerous techniques for boiler cleaning are in use today. One approach is the use of so called sootblowers which project a stream of cleaning medium such as air, steam, and water, or mixtures of these materials against the boiler surfaces which causes the accumulated encrustations to be removed through mechanical and thermal shock.

Various types of sootblower systems are used. One type of sootblower is positioned permanently in the boiler and is actuated periodically to eject a sootblowing medium. Other types include the so-called long retracting sootblowers in which a lance tube is periodically advanced into and retracted from the heat exchanger and features one or more nozzles at its outer tip from which the cleaning medium is ejected. The retraction feature of these sootblowers enables the lance tube to be removed from the intense heat within the heat exchanger or boiler which would otherwise damage the lance tube. Many of the retracting sootblower types also cause the lance tube to be simultaneously rotated as it is axially extended into and out of the boiler so that the stream of sootblowing medium traces a helical path during the actuation cycle. Sootblowers are normally operated intermittently in accordance with a schedule which comprehends cleaning requirements, sootblower medium consumption, and various other factors.

In cases where steam or a mixture which includes steam is used as the cleaning medium and the sootblower is actuated intermittently, there is a tendency for the steam which remains in the sootblower associated plumbing to condense between actuation cycles. At the beginning of the next actuation cycle when the cleaning medium is again forced into the lance tube to be ejected from the cleaning nozzles, the condensate is initially expelled in the form of liquid slug. Some condensate will also be formed as the steam initially contacts the relatively cool sootblower internal surfaces. In some conditions, when such a slug of condensate strikes the heat exchange surfaces being cleaned, undesirable boiler tube erosion occurs due to an excessive level of thermal and mechanical shock. Such degradation of the heat exchange surfaces of a boiler can produce catastrophic failures and a significant financial loss for the boiler operator.

This invention is related to a sootblower system incorporating a condensate separating system within the lance tube which causes condensate forming between and during operating cycles to be ejected from the lance tube away from the heat exchange surfaces being cleaned and harmlessly into the interior of the boiler where it is vaporized. The sootblower cleaning nozzles which are aimed at the heat exchange surfaces to be cleaned spray a steam or steam/air mixture relatively free of condensate. Accordingly, this invention is capable of substantially minimizing the erosive effect of the initial output of a slug of condensate against heat exchange surfaces in a boiler. Moreover, the condensate separating effect provided by this invention allows the use of saturated steam or a steam/water mixture for the purposes of cooling the lance tube, while avoiding the degree of heat exchanger erosion which would occur if all the liquid water were sprayed against the heat exchanger surfaces.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
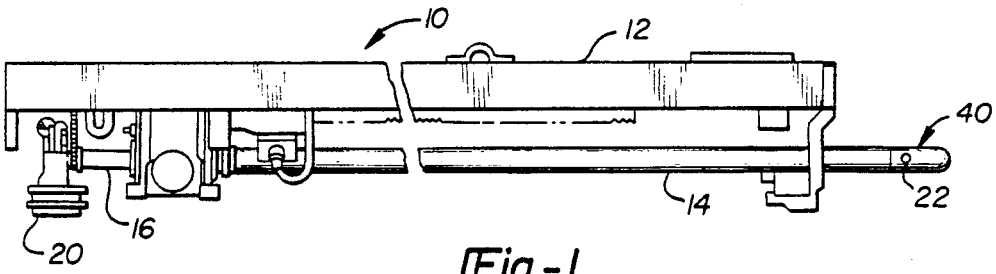
FIG. 1 is a pictorial view of a long retracting sootblower which is an example of one type of sootblower with which the present invention can be employed.

FIG. 1 illustrates a long retracting type sootblower which is an example of one type which can be employed with the present invention. The sootblower as shown in FIG. 1 is generally designated by reference number 10 and has a construction as disclosed by U.S. Pat. No. 3,439,376 granted to J. E. Nelson et al on Apr. 22, 1969, which is hereby incorporated by reference. Sootblower 10 principally comprises frame assembly 12, lance tube 14, feed tube 16 and carriage 18. Sootblower 10 is shown in its normal resting position. Upon actuation, lance tube 14 is extended into and retracted from a boiler and is simultaneously rotated. A sootblowing cleaning medium such as air, steam, or water, or a mixture of these fluids (or some other material) is supplied to blow valve 20 and fed through feed tube 16 which is held stationary. As lance tube 14 is extended into the boiler, it telescopes over feed tube 16. A fluid seal (not shown) is provided between tubes 14 and 16 to enable the sootblowing medium to be ejected form one or more cleaning nozzles 22.

Figure 2:
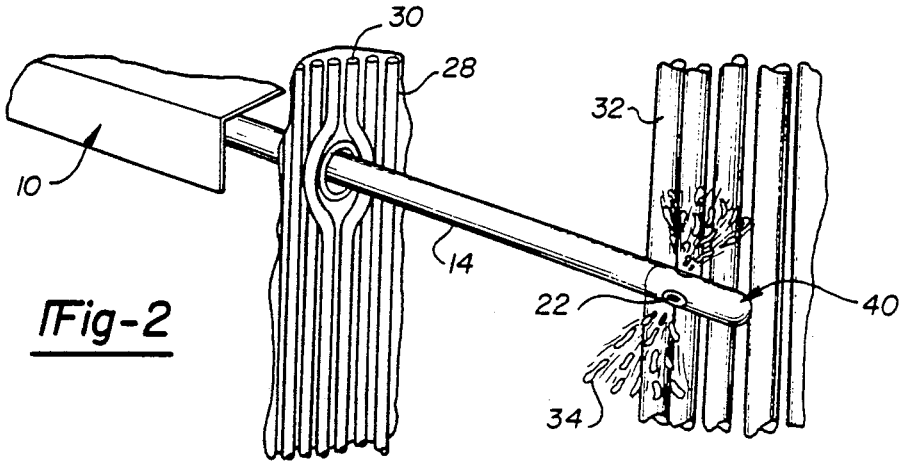
FIG. 2 is a pictorial view of a conventional sootblower showing condensate being ejected against a pendant section of boiler tubes.

Now with reference to FIG. 2, a sootblowing system of a conventional configuration is shown to illustrate the advantages provided by the present invention. As shown in FIG. 2, lance tube 14 is shown protruding through the side wall 28 of the heat exchanger which is covered by an array of heat transfer wall tubes 30. In this application sootblower 10 is provided for cleaning a pendant (i.e. hanging) section of boiler tubes 32. Another row of pendant tubes 32 would be provided laterally opposite the section shown but is removed for the sake of illustration. As discussed previously, in applications where steam or a steam/air mixture is used as a cleaning medium, between actuation cycles, steam which remains within lance tube 14 ,feed tube 16 and the associated fluid circuit can condense. In such instances, at the starting point of the blowing cycle, the condensed and condensing liquid is ejected forcibly from sootblower cleaning nozzles 22. As illustrated in FIG. 2, such unpurged condensate formed int eh feed system or the sootblower itself is blown out at high velocity through the nozzle 22 onto pendant section boiler tubes 32 and is shown in the form of droplets or slugs 34.

Figure 3:
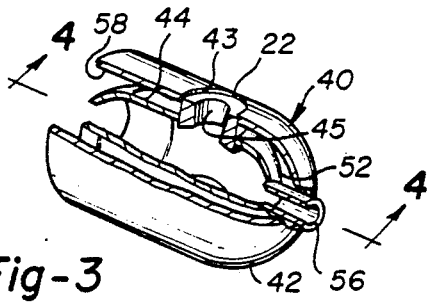
FIG. 3 is a partially cut away pictorial view of the condensate separation nozzle block of the sootblower lance tube shown in FIG. 1 according to a first embodiment of this invention.
Figure 4:
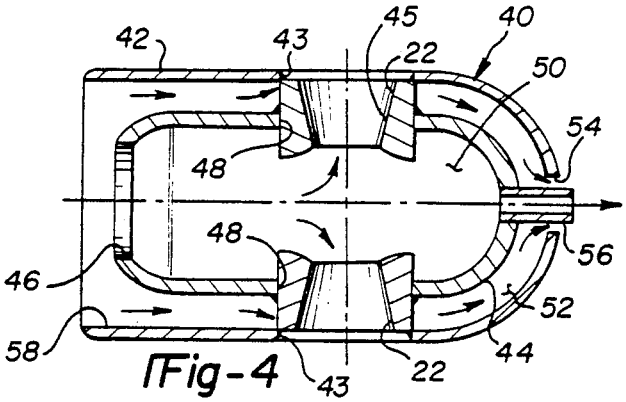
FIG. 4 is a cross-sectional view taken through the lance tube tip of FIG. 3 showing the internal construction of a condensate separation nozzle.

Now with reference to FIG. 3 and 4, a nozzle block 40 in accordance with a first embodiment of this invention is shown. Nozzle block 40 is attached to the end of lance tube 14 and includes an outer shell 42 which generally has the same outer diameter as that of lance tube 14. A pair of cleaning nozzles 22 are recessed into apertures 43 and welded to nozzle block shell 42. The nozzles have venturi shaped throats 45 for providing a concentrated spray of cleaning medium.

Internal baffle 44 is positioned inside nozzle block 40 and has an entrance opening 46, and a pair of apertures 48 allowing cleaning nozzles 22 to pass radially through the baffle. Baffle 44 is welded or otherwise integrally connected to cleaning nozzles 22. Baffle 44 defines an internal cavity 50 which is supplied with cleaning medium exclusively through entrance opening 46 which is concentrically positioned within nozzle block 40. Baffle 44 is spaced from the distal end or tip of nozzle block 40 and has a smaller external diameter than shell inside diameter 58 thereby defining condensate flow passage 52. Aperture 54 at the distal end or tip of nozzle block 40 is provided for the elimination of condensate, as will be explained in greater detail below. Nozzle 56 communicates with baffle internal cavity 50 and is concentrically oriented with respect to the nozzle block and aperture 54.

Nozzle block 40 substantially reduces the quantity of condensed sootblowing medium which is ejected from cleaning nozzles 22 by using the principle that condensed liquids within lance tube 14 and nozzle block 40 tend to form and collect on tube inside surface 58 and that the higher density liquids are unable to change flow direction as readily as a vapor. Baffle entrance opening 46 has an area smaller than the inside surface 58 of the nozzle block and is spaced radially inward so that only the cleaning medium flowing in the central core area of lance tube 14 which is relatively free of condensate, enters baffle 44. The diameter of baffle opening 46 of approximately one-half of that of the inside surface 58 has is believed to provide a high degree of condensate separation. The condensate collecting against inside surface 58 is forced by cleaning medium fluid pressure to pass into flow passage 52 where it is allowed to escape through end aperture 54. At the beginning of the sootblowing actuation cycle, slugs of condensate are ejected from aperture 54 and into the inside of the boiler, away from pendant tubes 32, and is vaporized in a harmless manner. After the condensate is eliminated, cleaning medium continues to escape through aperture 54.

Although most of the liquid condensate within lance tube 14 forms an annulus near the lance tube wall, some liquid is also found in the center area. For this reason, nozzle 56 is provided to create an axial flow component for the sootblowing medium. By the principle of the liquid being less able to make the abrupt turn into nozzles 22, additional liquid is ejected through nozzle 56.

Figure 5:
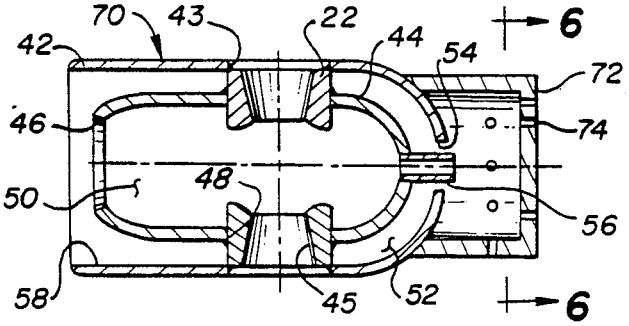
FIG. 5 is a cross-sectional view similar to FIG. 4 but showing a second embodiment of a condensate separation nozzle according to this invention.
Figure 6:
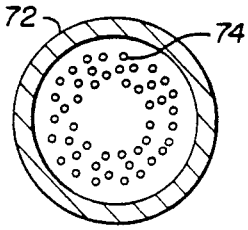
FIG. 6 is a cross-sectional view taken along line 6—6 of FIG. 5.

FIGS. 5 and 6 illustrate a second embodiment of a nozzle block 70 in accordance with this invention. Since nozzle block 70 shares many features with those of nozzle block 40, those elements are identified by like reference numbers. Nozzle block 70 incorporates a diffuser baffle 72 which has a multiplicity of small exit openings 74 for breaking up the flow of condensate from aperture 54 to further minimize the chance of the ejected condensate causing tube damage.

Figure 7:
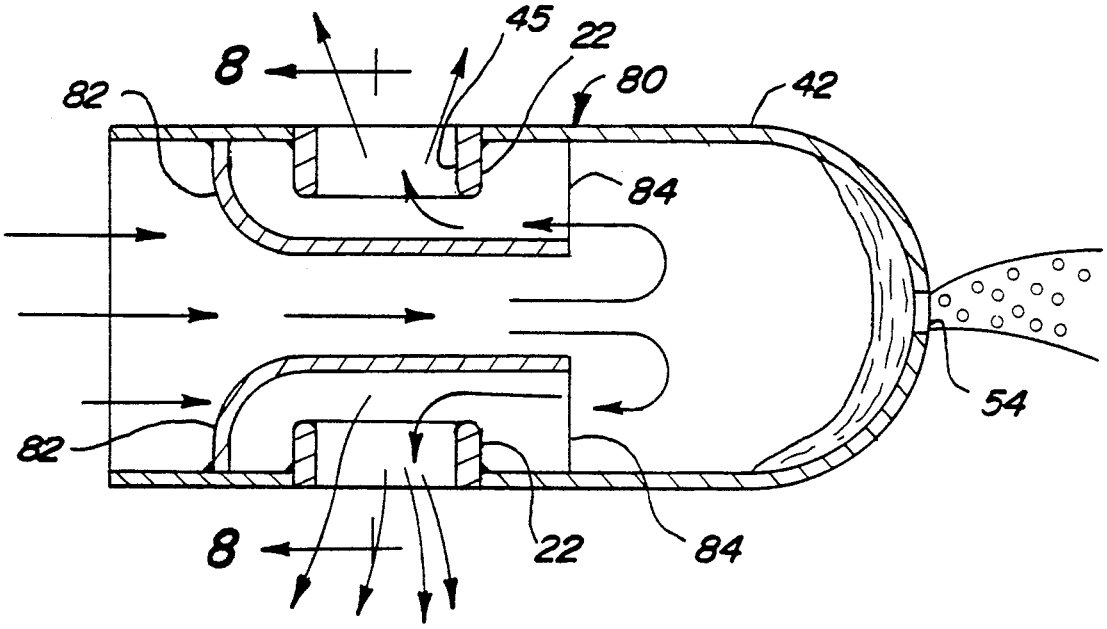
FIG. 7 is a cross-sectional view of a condensate separation nozzle block according to the third embodiment of this invention.
Figure 8:
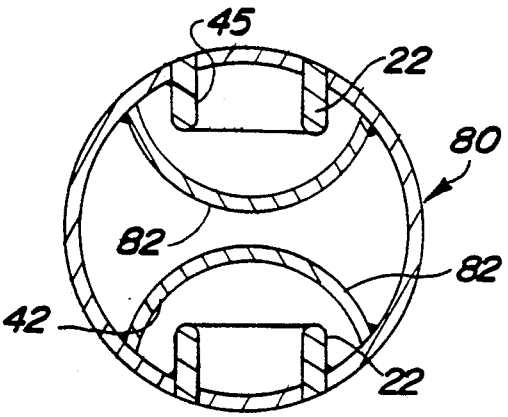
FIG. 8 is a cross-sectional view taken along line 8—8 of FIG. 7.

FIG. 7 and 8 illustrate a nozzle block in accordance with a third embodiment of this invention which is designated by reference number 80. As with the second embodiment, elements common with the first embodiment are designated by like reference numbers. This embodiment differs from those described previously with respect to the shape of the baffle element used to separate steam from condensate. For this embodiment, cleaning nozzles 22 are shrouded by a pair of baffles 82 having a half-shell configuration. Baffles 82 are welded to the inside surface of shell 42 to close off the nozzles from direct communication with the steam and water mixture flowing down lance tube 14. Baffles 82 have an opening 84 facing the terminal end of nozzle block 80. As in the prior embodiments, a condensate eliminating aperture 54 is provided. In operation, when a sootblowing medium having condensate entrained within it is fed through the lance tube 14, it must pass through the restricted area between baffles 82. Thereafter, as shown in the figures, the fluid must undergo a severe change in direction as designated by the arrows in order to enter through openings 84 and thereafter flow out of nozzles 22. Due to the significantly lower density of steam as compared with the condensate, the steam is more able to undergo the change in direction to be ejected from nozzles 22 than is the condensate. The condensate instead tends to continue to flow in an axial direction and collects at the terminal end of nozzle block 80 where fluid pressure causes it to be ejected from end aperture 54.

While the above description constitutes the preferred embodiments of the present invention, it will be appreciated that the invention is susceptible of modification, variation and change without departing from the proper scope and fair meaning of the accompanying claims.

We claim:

1. A sootblower nozzle block assembly carried by a sootblower lance tube for projecting a jet of a sootblowing medium such as steam or a steam/air mixture against internal surfaces of a heat exchanger for causing soot or slag encrustations to be removed from said internal surfaces, comprising:

nozzle block housing means having a hollow interior passage for the flow of said sootblowing medium, condensate separator means within said nozzle block housing for separating out condensate of said sootblowing medium present in said lance tube, cleaning nozzle means carried by said nozzle block housing for projecting said jet of sootblowing medium against said internal surfaces, and condensate ejection means for allowing condensate separated by said condensate separator means to escape said lance tube and being prevented from being projected through said cleaning nozzle means.

2. A sootblower nozzle block assembly according to claim 1 wherein said condensate ejection means comprises an aperture for projecting a stream of said condensate from the distal end of said nozzle block housing means in an axial direction relative to said lance tube.

3. A sootblower nozzle block assembly according to claim 2 further comprises a diffuser baffle covering said condensate ejection aperture for breaking up the steam of condensate issuing from said aperture.

4. A sootblower nozzle block assembly according to claim 1 wherein said cleaning nozzle means projects said jet of sootblowing medium in a generally radial direction relative to said lance tube.

5. A sootblower nozzle block assembly according to claim 1 wherein said condensate separator means comprises a baffle positioned adjacent said cleaning nozzle means defining an entrance orifice of a diameter less than the inside diameter of said nozzle block interior passage and oriented concentrically within said nozzle block housing, the interior of said baffle in communication with said cleaning nozzle means allowing said sootblowing medium entering said entrance orifice to pass through said nozzle means and said baffle defining a condensate flow passage formed radially between said nozzle block interior passage and said baffle communicating with said condensate ejection means.

6. A sootblower nozzle block assembly according to claim 5 wherein said condensate ejection means comprises a condensate ejection aperture communicating with said condensate flow passage.

7. A sootblower nozzle assembly according to claim 6 further comprising an end nozzle communicating with the interior of said baffle and axially aligned with said condensate flow passage for allowing condensate entering said condensate flow passage to be ejected from said nozzle assembly.

8. A sootblower nozzle block assembly according to claim 1 wherein said condensate separator means comprises baffle means for forcing said sootblowing medium to undergo a reversal in flow direction in order to escape said cleaning nozzle means whereby at least a portion of said condensate is prevented from escaping said cleaning nozzle means.

9. A sootblower nozzle block assembly according to claim 8 wherein said baffle means comprises a shell which overlies said cleaning nozzle means and having an opening facing the distal end of said nozzle block whereby at least a portion of said condensate is prevented from escaping said cleaning nozzle means.

10. A sootblowing means block assembly for projecting a jet of a sootblowing medium such as steam or a steam/air mixture against internal surfaces of a heat exchanger for causing soot or slag encrustation to be removed from said internal surfaces, comprising:

a sootblower nozzle block housing having a hollow interior passage for the flow of said sootblowing medium, a condensate separator baffle positioned inside said nozzle block internal passage and defining an interior cavity with an entrance orifice of a diameter less than the inside diameter of said nozzle block housing interior passage and oriented concentrically within aid nozzle block housing interior passage and further defining a condensate flow passageway formed radially between said nozzle block housing interior passage and said baffle, whereby said sootblowing medium which is relatively free of said condensate flows into said baffle entrance orifice, whereas said condensate which tends to collect on the inside surfaces of said nozzle block flows into said condensate flow passage, one or more cleaning nozzle communicating with said interior cavity of said baffle and oriented to direct said jet of sootblowing medium conducted into said baffle entrance orifice toward said heat exchanger internal surfaces, and a condensate ejection aperture located at the distal end of said lance tube and communicating with said condensate flow passageway for allowing said condensate collecting within said lane tube and said nozzle block housing to be directed through said condensate flow passageway and ejected out of said condensate ejection aperture whereas sootblowing medium entering said baffle entrance is ejected through said cleaning nozzles.

11. A sootblower nozzle block assembly according to claim 10 further comprising an end nozzle axially aligned with said baffle entrance orifice and communicating with said baffle interior cavity for allowing condensate entering said condensate flow passage to be ejected from said nozzle assembly.

12. A sootblower nozzle block assembly according to claim 10 further comprises a diffuser baffle covering said condensate ejection aperture for breaking up the stream of condensate issuing from said aperture.

13. A sootblower nozzle block assembly according to claim 10 wherein said cleaning nozzles are oriented to project said stream of sootblowing medium in a radial direction relative to said lance tube.

14. A sootblower nozzle block assembly for projecting a jet of a sootblowing medium such as steam or a steam/air mixture against internal surfaces of a heat exchanger for causing soot or slag encrustations to be removed from said internal surfaces, comprising:

a sootblower nozzle block housing having a hollow interior passage for the flow of said sootblowing medium, at least one cleaning nozzle communicating with said interior passage, a condensate separator baffle having an opened shell configuration which overlies said cleaning nozzle and defines an interior cavity communicating with said cleaning nozzle and with said nozzle block having interior passage through an opening which is positioned to cause said sootblowing medium to undergo a sharp change in direction upon entering said cavity so as to prevent at least some of said condensate from being ejected from said cleaning nozzle, and a condensate ejection aperture oriented to communicate with condensate which was unable to undergo said sharp change in direction.

15. A sootblowing nozzle block assembly for projecting a jet of a sootblowing medium according to claim 14 wherein said baffle opening faces the distal end of said lance tube and said condensate ejection aperture is located at said distal end.

* * * * *